US007256749B2

(12) United States Patent
DeSargant et al.

(10) Patent No.: US 7,256,749 B2
(45) Date of Patent: Aug. 14, 2007

(54) COMPACT, MECHANICALLY SCANNED CASSEGRAIN ANTENNA SYSTEM AND METHOD

(75) Inventors: Glen J DeSargant, Anaheim, CA (US); Albert L Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 79 days.

(21) Appl. No.: 11/130,550

(22) Filed: May 17, 2005

(65) Prior Publication Data

US 2006/0262022 A1 Nov. 23, 2006

(51) Int. Cl.
*H01Q 13/00* (2006.01)

(52) U.S. Cl. ..... 343/781 CA; 343/781 P

(58) Field of Classification Search ..... 343/757, 343/765, 781 R, 785, 786, 761, 766, 781 CA, 343/781 P See application file for complete search history.

(56) References Cited

U.S. PATENT DOCUMENTS

| | | | | |
|---|---|---|---|---|
| 3,573,740 A | | 4/1971 | Berger et al. | |
| 4,646,993 A | | 3/1987 | Baetke | 244/117 R |
| 4,887,091 A | * | 12/1989 | Yamada | 343/714 |
| 5,044,578 A | | 9/1991 | White et al. | 244/119 |
| 5,077,671 A | | 12/1991 | Leslie et al. | 701/3 |
| 5,079,707 A | | 1/1992 | Bird et al. | 701/35 |
| 5,175,198 A | | 12/1992 | Minnick et al. | 533/222 |
| 5,307,505 A | | 4/1994 | Houlberg et al. | 709/253 |
| 5,424,949 A | | 6/1995 | Applegate et al. | 701/14 |
| 5,428,650 A | | 6/1995 | Pitot | 375/377 |
| 5,761,625 A | | 6/1998 | Honcik et al. | 701/14 |
| 5,805,828 A | | 9/1998 | Lee et al. | 709/249 |
| 5,841,969 A | | 11/1998 | Fye | 714/56 |
| 5,859,619 A | * | 1/1999 | Wu et al. | 343/781 CA |
| 5,970,395 A | | 10/1999 | Weiler et al. | 714/56 |
| 6,047,165 A | | 4/2000 | Wright et al. | 455/66.1 |

(Continued)

OTHER PUBLICATIONS

Master Sgt. Patrick E. Clark, "Pacer CRAG, Command's KC-135s receiving avionics, navigation upgrades," Citizen Airman, Feb. 1999, http://www.fas.org/nuke/guide/usa/bomber/990200-carg.htm; 2 pages.

(Continued)

*Primary Examiner*—Douglas W. Owens
*Assistant Examiner*—Jimmy Vu
(74) *Attorney, Agent, or Firm*—Harness, Dickey & Pierce, P.L.C.

(57) ABSTRACT

A mechanically scanned reflector antenna system that produces a compact swept diameter and overall height, which is ideally suited for use on the external surface of a high speed mobile platform where a low profile, lightweight antenna is needed. The antenna system includes a main reflector and a subreflector both formed from composite materials. A support assembly includes a pair of arms that cantilever the main reflector forwardly of a base portion of the support assembly such that a portion of the main reflector can be positioned below an upper surface of the base portion. This enables the vertical height of the swept arc of the main reflector to be reduced when the main reflector is rotated about its elevation axis. The assembly provides an even more compact system that can be enclosed within a smaller radome when the system is employed on an external surface of a high speed mobile platform.

19 Claims, 5 Drawing Sheets

U.S. PATENT DOCUMENTS

| | | | | |
|---|---|---|---|---|
| 6,104,914 | A | 8/2000 | Wright et al. | 455/66.1 |
| 6,108,523 | A | 8/2000 | Wright et al. | 455/66.1 |
| 6,148,179 | A | 11/2000 | Wright et al. | 455/66.1 |
| 6,154,636 | A | 11/2000 | Wright et al. | 455/66.1 |
| 6,154,637 | A | 11/2000 | Wright et al. | 455/66.1 |
| 6,160,998 | A | 12/2000 | Wright et al. | 455/66.1 |
| 6,163,681 | A | 12/2000 | Wright et al. | 455/66.1 |
| 6,167,238 | A | 12/2000 | Wright | 455/66.1 |
| 6,167,239 | A | 12/2000 | Wright et al. | 455/66.1 |
| 6,173,159 | B1 | 1/2001 | Wright et al. | 455/66.1 |
| 6,181,990 | B1 | 1/2001 | Grabowsky et al. | 701/14 |
| 6,278,396 | B1 | 8/2001 | Tran | 342/29 |
| 6,353,734 | B1 | 3/2002 | Wright et al. | 455/98 |
| 6,462,718 | B1 * | 10/2002 | Ehrenberg et al. | 343/880 |
| 6,477,152 | B1 | 11/2002 | Heitt | 370/316 |
| 6,559,812 | B1 | 5/2003 | McCarten et al. | 345/2.1 |
| 6,671,589 | B2 | 12/2003 | Holst et al. | 701/3 |
| 7,042,409 | B2 * | 5/2006 | Desargant et al. | 343/765 |
| 7,095,380 | B2 * | 8/2006 | Yoneda et al. | 343/786 |
| 2002/0111720 | A1 | 8/2002 | Holst et al. | 455/66.1 |
| 2003/0003872 | A1 | 1/2003 | Brinkley et al. | 701/35 |
| 2003/0069015 | A1 | 4/2003 | Brinkley et al. | 455/66.1 |
| 2003/0184487 | A1 * | 10/2003 | Desargant et al. | 343/781 P |

OTHER PUBLICATIONS

"KC-135R Stratotanker, Pacer CRAG (Compass, Radar and GPS)," http://www.globalsecurity.org/military/systems/aircraft/kc-135r-pacer-crag.htm; 4 pages.

"The Next Generation of Aircraft Data Link," Rockwell Collins, 2002, 13 pages.

"Databus Tutorial," Ballard Technology, Inc., http://www.ballardtech.com/tutorial.asp, 4 pages.

"Wireless GroundLink®," Teledyne Controls, http://www.teledyune-controls.com/productsolution/wirelessgroundlink/groundlink.asp, 1 page.

CNS Systems Inc. "Data Communications for the Air Transport Industry," Feb. 1998, pp. 1-3, http://www.cnssys.com/ATC-Data-Comm.html.

* cited by examiner

Prior Art

COMPACT, MECHANICALLY SCANNED CASSEGRAIN ANTENNA SYSTEM AND METHOD

FIELD OF THE INVENTION

This invention relates to antenna apertures, and more particularly to a mechanically scanned reflector antenna apparatus that requires only a small swept volume with minimum height and weight, thus making the apparatus ideally suited for use on the external surfaces of high speed mobile platforms.

BACKGROUND OF THE INVENTION

With the increase in digital communications between geostationary satellites and various forms of mobile platforms, such as high speed aircraft, the need for an optimized, physically small, lightweight, low power, mechanically scanned antenna structure has grown in importance. In applications where such a mechanically scanned antenna system needs to be located on the external surface of a high speed mobile platform such as a jet aircraft, the need for a lightweight antenna system that is also compact and that can be mechanically scanned about both azimuth and elevation axes, with low power and within a small swept volume, is especially important. The heavier the apparatus, the greater are the forces applied to the external surface of the aircraft, and the costlier is the structural reinforcement required for installation. The heavier the mechanically rotating sections of the apparatus the greater the motor drive power required for rotation. The added weight of the heavier apparatus, structural reinforcement and rotating components contribute to losses in fuel economy and reduction in the prime power of the mobile platforms. Thus, it should be apparent that any structure that allows for supporting the aperture so that the overall swept volume of the aperture can be minimized by an amount X, will reduce the height and footprint of the radome that needs to be used to cover the aperture by a corresponding amount.

Weight is an especially important factor for a mechanically scanned antenna aperture used on mobile platforms. This is especially true on high speed mobile platforms such as military and commercial aircraft. Minimizing the weight of the aperture and its associated supporting structure, without reducing the strength and robustness of the aperture and its supporting structure, is highly desirable because it minimizes the adverse effect on fuel economy that the aperture could otherwise produce.

Another important factor for a mechanically scanned system on a mobile platform is to minimize the size of the antenna aperture. The smaller the antenna aperture, the smaller is the swept volume and the radome needed to cover the aperture. The less the aerodynamic drag on the small mobile platform, the lower the fuel costs will be for operating the vehicle. Another consideration is that the antenna aperture size is part of the transmit function's effective isotropic radiated power (EIRP) and the receiver function's gain over temperature (G/T). RF losses degrade both EIRP and G/T in communications between mobile platforms near the earth and Ku- and Ka-band satellites in distant geostationary orbits. Minimizing RF losses helps to promote smaller antenna apertures, smaller radomes and produce smaller aerodynamic drag.

Another important factor for a mechanically scanned system on a mobile platform is minimizing the power required for the motors, which drive the mechanically scanned system (reflector, sub-reflector, waveguide, components, structure, etc.) about the elevation and azimuth axes. The smaller and lighter the aperture structure is, the more likely that less powerful motors can be implemented.

With brief reference to FIGS. 1 and 2, the swept volume consideration is illustrated. FIG. 1 illustrates a mechanically scanned aperture that is rotated about a pivot point "P", when viewing the aperture from a plan or top view. The dashed line "D" represents the minimum swept area that is required in the azimuth plane for the aperture to be rotated 360°. The closer the pivot point "P" is to the back of the aperture, the smaller is the minimum swept volume. The azimuth axis of rotation is centered within a radio frequency (RF) rotary joint. The diameter of the RF rotary joint in the azimuth plane determines the minimum spacing between the pivot point and the antenna aperture and the ensuing minimum azimuth swept area. "A small diameter, compact coaxial or waveguide rotary joint is required to minimize the azimuth swept area. The bottom section of the rotary joint is stationary and the top section rotates. In practice, a 2-channel rotary joint is required to allow for the vertical and horizontal polarized RF signals to connect to the RF ports on the mechanically scanning antenna on top, and the fixed RF ports connected to the mobile platform supporting structure on the bottom. FIG. 2 illustrates the elevation axis pivot point $P_E$. The aperture is shown in a vertical orientation in dashed lines, and the dashed line arc represents the swept volume required for scanning from a horizontal plane to a vertical plane about 360° of azimuth rotation. The height and depth of the apparatus, (aperture and attached components) must be optimized for minimum size, in addition to selecting the elevation rotational axis within the center of the apparatus in the elevation plane to minimize the vertical swept volume. FIG. 2 also illustrates that the structure supporting the aperture typically makes use of some form of supporting assembly that comprises a stationary member and a movable member positioned on top of the stationary member. The total thickness of these two elements also contributes to the swept volume required for the two aperture axes.

SUMMARY OF THE INVENTION

The present invention is directed to a mechanically scanned antenna apparatus that requires a smaller swept volume than previously developed mechanically scanned antenna apertures. The present invention utilizes size, weight and power optimization techniques involving small, light weight components, and by reducing rotational radii, and torques through the use of lightweight, small components and composite construction.

In one preferred form the apparatus of the present invention includes a main reflector that is supported from a support assembly. The support assembly includes a pair of arms that cantilever the main reflector forward of a rotating base portion of the support assembly and forward of a stationary base structure mounted on the platform. The main reflector is further pivotally supported, for elevation movement, from the arms of the support assembly. Supporting the main reflector in this manner enables the main reflector to be supported at a point elevationally below the base portion of the support assembly and with a minimal vertical height above the top surface of the structure on which the antenna apparatus is mounted.

In various preferred embodiments the apparatus includes one or more electronic components mounted on a rear surface of the main reflector. The one or more electronic components are in electrical communication with external electronics subsystems via elevation rotary joints supported on both of the arms of the support assembly. The elevation rotary joints are coupled, via suitable conductors, to an azimuth axis rotary joint mounted on the base portion of the support assembly.

In other preferred embodiments the main reflector and the support assembly are both of a composite construction to provide excellent structural strength yet light weight, as compared to other commonly used materials such as aluminum and/or steel. In one preferred form a subreflector is supported from a front surface of the main reflector and is also of a composite construction. The extensive use of lightweight composite materials and lightweight stepper motors, instead of common, heavier servo motor systems, eliminate the need for the use of weight counterbalances commonly used in antenna systems where the reflector, sub reflector and structure are fabricated of solid metal.

The various preferred embodiments provide a mechanically scanned antenna aperture that requires a smaller swept volume than previously developed mechanically scanned reflector antenna systems. In addition, the preferred embodiments are even lighter in weight than such traditional, mechanically scanned reflector antenna systems.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

This invention relates to a mechanically scanned antenna system, preferably a Ku-band or Ka-band system, that is optimized for minimum size, weight and power. An optimized system insures the smallest swept volume, minimum structural impact and lowest RF and mechanical scanning power requirements. The optimized system is ideally suited for use on the external surfaces of smaller classes of mobile platforms such as aircraft (e.g., Boeing 737), trains and buses, as well as marine vessels. This invention also combines various features of U.S. Pat. Nos. 6,861,994, 6,642,905, 6,717,552, all of which are hereby incorporated by reference into the present application, with composite construction and small, light weight, lower power components.

Figure 1:
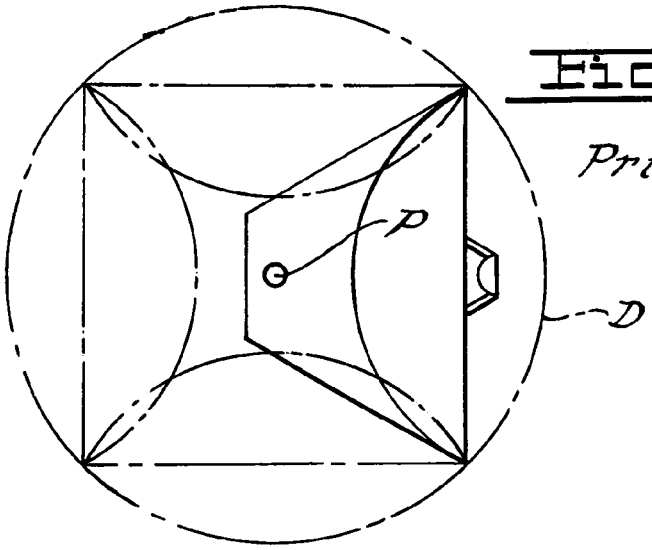
FIG. 1. Prior Art
FIG. 1 is a plan view of a prior art antenna aperture and support assembly illustrating the required swept arc footprint required for 360° scanning of the aperture about its azimuth axis of rotation.
Figure 2:
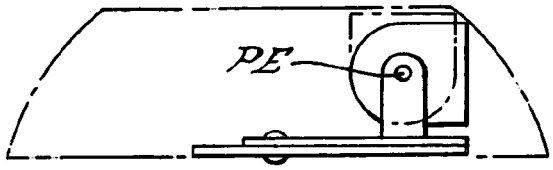
FIG. 2 is a side view of the aperture of FIG. 1 illustrating the swept arc required for scanning of the aperture about its elevation axis, in addition to illustrating the overall swept volume that is needed for both azimuth and elevation scanning of the aperture over its full range of movement.
Figure 3:
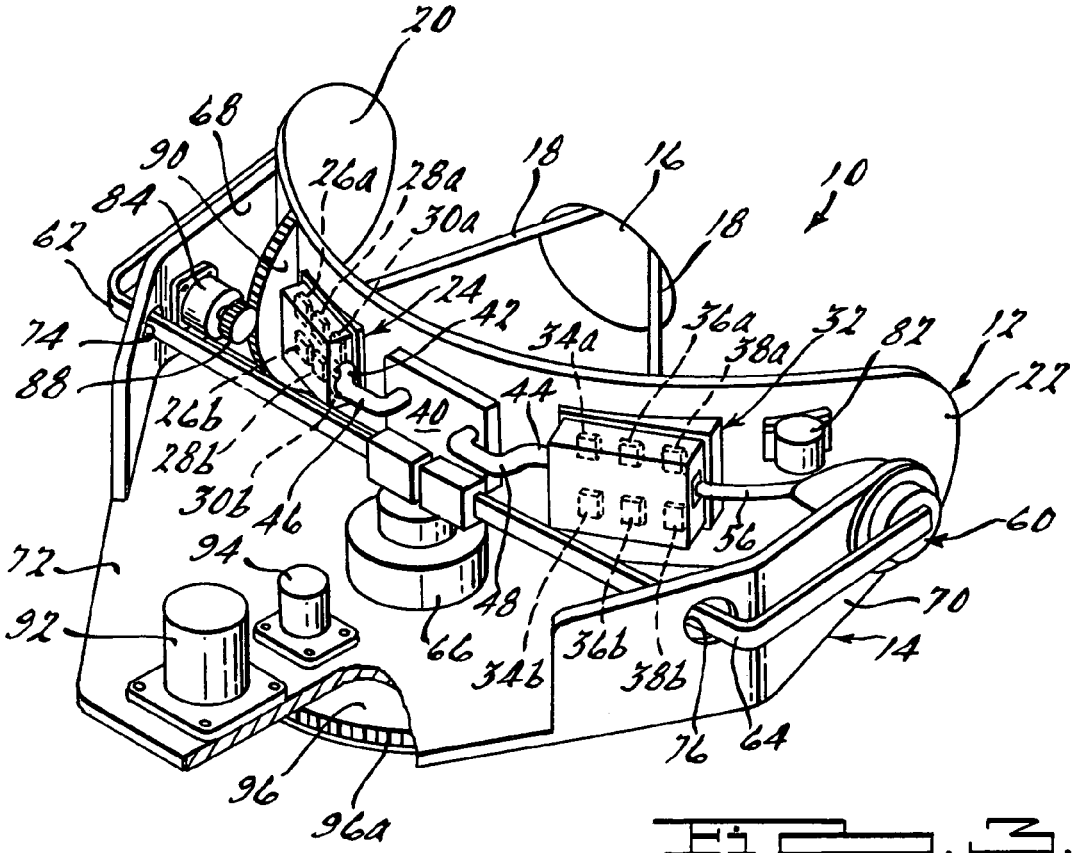
FIG. 3 is a perspective view of a mechanically scanned reflector antenna system in accordance with a preferred embodiment of the present invention.

Referring to FIG. 3, there is shown a mechanically scanned antenna system 10. The system 10 includes a main reflector 12 supported by a support assembly 14. The main reflector 12 includes a subreflector 16 supported by one or more struts 18 from the front edges of the main reflector 12.

Figure 4:
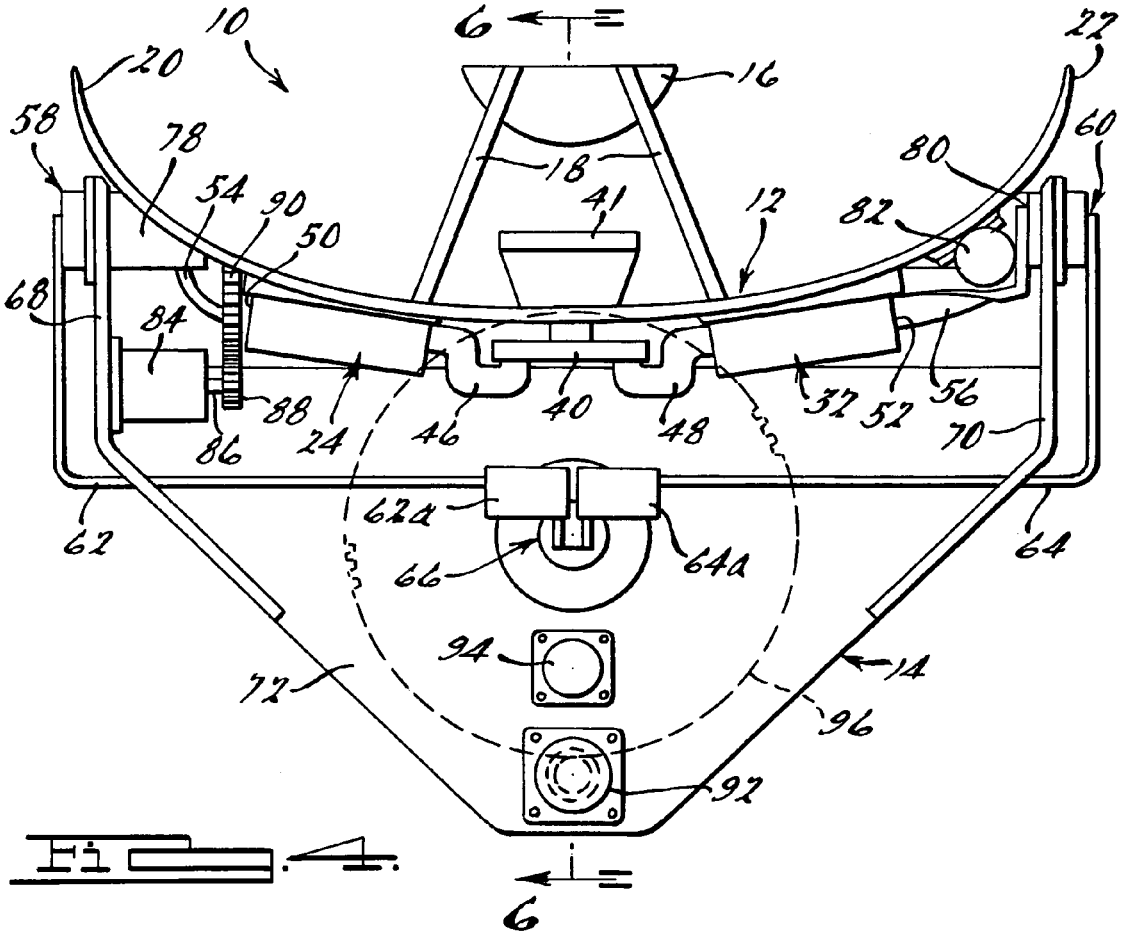
FIG. 4 is a plan view of the system of FIG. 3.

At a rear surface 22 of the main reflector 12, a plurality of electronic components are supported. These components include a first module 24 that preferably includes a pair of diplexers 26*a*, 26*b*, a pair of low noise amplifiers 28*a*, 28*b* and a pair of band pass filters 30*a*, 30*b*, that are all represented in highly simplified form. A second module 32 that also includes a pair of diplexers 34*a*, 34*b*, a pair of low noise amplifiers 36*a*, 36*b* and a pair of bandpass filters 38*a*, 38*b*. Each of the modules 24 and 32 are in communication with an orthomode transducer 40 and a pair of ports 42 and 44. Ports 42 and 44 are coupled via waveguide sections 46 and 48, with the modules 24 and 32. In FIG. 4, the orthomode transducer 40 is coupled to a feed horn 41.

With further reference to FIGS. 3 and 4, each of the modules 24 and 32 also include output ports 50 and 52 that are electrically coupled via waveguide sections 54 and 56 with a pair of conventional elevation rotary joints 58 and 60. The elevation rotary joints 58 and 60 couple signals to and from the modules 24 and 32 via waveguide sections 62 and 64 and conventional waveguide-to-coaxial couplers 62*a* and 64*a*, with an azimuth axis rotary joint assembly 66. In one preferred form the rotary joint assembly 66 forms a two channel rotary axis joint that enables vertical polarization (transmit and receive) signals on the first channel and horizontal polarization signals (transmit and receive) on the second channel.

Figure 5:
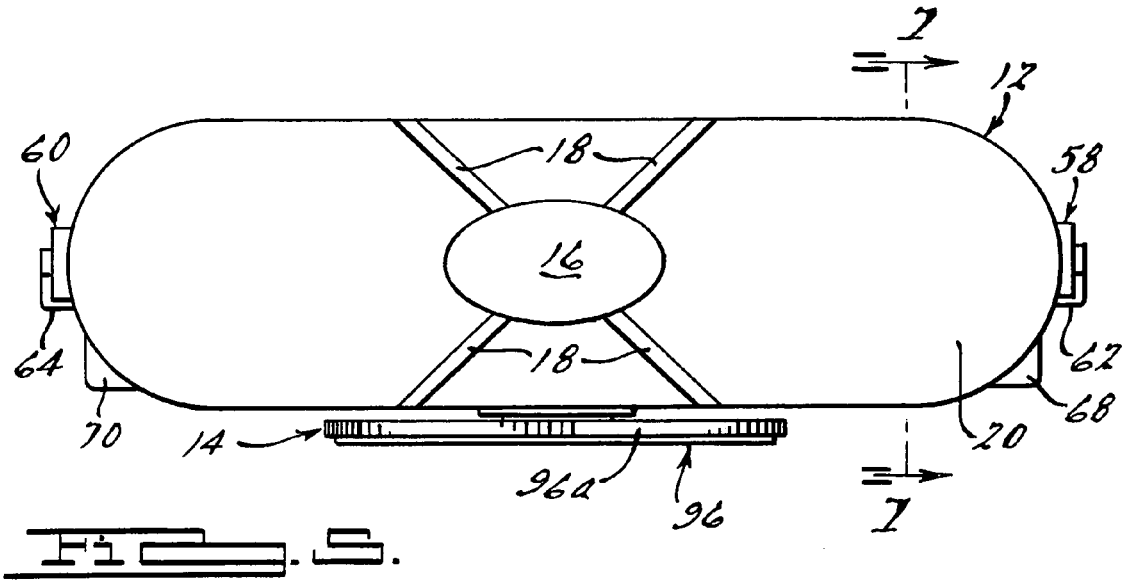
FIG. 5 is a front view of the system of FIG. 4.

With further reference to FIGS. 3-5, the support assembly 14 includes a pair of arm portions 68 and 70 that extend from a base portion 72. The base 72 and support arm portions 68 and 70 are made of lightweight composite materials, and preferably from fiberglass honeycomb construction. Arm portions 68 and 70 may include holes 74 and 76 to reduce the length of the waveguide sections 62 and 64 needed to reach the azimuth rotary joint 66. The main reflector 12 is supported for pivotal movement about the elevation axis by a pair of suitable bosses 78 and 80 visible in FIGS. 4 and 5. Bosses 78 and 80 preferably are an integral part of the main reflector 12. The elevation rotary joints 58 and 60 are attached to the bosses 78 and 80 on the rear surface 22, of the main reflector 12 to permit rotation of the main reflector 12 about the elevation axis.

With further reference to FIGS. 3 and 4, also supported from the rear surface 22 of the main reflector 12 is an elevation gyroscope 82 that is in electrical communication with the electronics of a vehicle navigational system of the mobile platform on which the system 10 is employed. This interface enables the elevation movements of the mobile platform to be detected by gyroscope 82 and used to control the elevation movement and thereby correct the position of the main reflector 12 so the electromagnetic beam will remain in communication with a target satellite or other target device. Interconnection between the gyroscope 82 and the mobile platform electronics is made via suitably flexible electrical conductors that can be routed along the same path as the waveguide sections 62 and 64. In FIG. 4, supported from the arms 68 is a DC elevation drive motor 84, preferably a stepper motor, having an output shaft 86 with a gear assembly 88 driven by the output shaft 86. With brief reference to FIG. 7, the gear assembly 88 is in contact with a curved, toothed, gear track 90 secured to the rear surface 22 of the main reflector 12. The toothed gear track 90 may be formed from steel, aluminum or any other suitable material and is preferably secured to the main reflector 12 by threaded fasteners, rivets or any other suitable means. The engagement of the gear assembly 88 with the toothed drive track 90 enables rotation of the main reflector 12 about its elevation axis by the motor 84.

With further reference to FIGS. 3 and 4, the composite support assembly 14 further includes an azimuth DC drive motor 92, also preferably a stepper motor, supported on the rotatable base portion 72. An azimuth gyroscope 94 is also supported on the base portion 72 and is electrically coupled to the electronics of the mobile platform navigational system. This interface enables the azimuth movements of the mobile platform to be detected by the gyroscope 94 and translated into commands to the azimuth drive motor 92 to drive the azimuth movement and thereby correct the position of the main reflector 12 so the electromagnetic beam from the reflector 12 will remain in communication with the target device (e.g., satellite). Interconnection between the gyroscope 94 and the vehicle electronics is made via suitably flexible electrical conductors (not shown) that can be routed preferably along the same path as the wavelength sections 62, 62, to the vicinity of the azimuth gyroscope 94.

Figure 6:
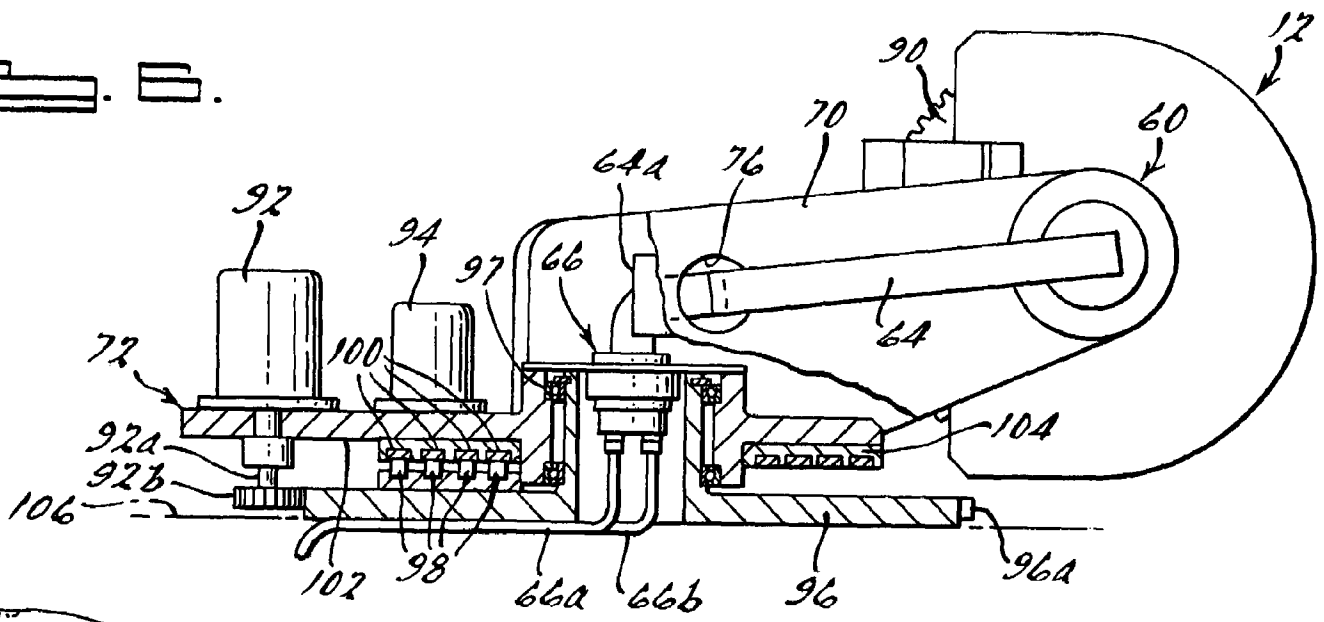
FIG. 6 is a cross-sectional side view of the system of FIG. 4 taken generally in accordance with section line 6-6 in FIG. 4, and illustrating the elevation swept arc produced by scanning of the main reflector about its elevation axis.

Referring to FIG. 3 and FIG. 6, the rotary joint assembly 66 is attached to a stationary support plate 96 that is fixed to the mobile platform. A roller bearing assembly 97 integrated between the base portion 72 and the support plate 96 provides rotational stability and smooth rotational movement of the base portion 72 relative to the support plate 96. Optionally, a metal insert or sleeve (not shown) could be used to support the bearing assembly 97, rather than supporting the bearing assembly directly on a surface portion of one of components 72 or 96.

The base portion 72 has a plurality of slip ring brushes 100 on an undersurface thereof. A plurality portion of slip rings 98 are supported on the stationary support plate 96. The slip rings 98 and brushes 100 are arranged so that a plurality of independent, electrically conductive channels are formed to communicate with the stepper motors 84 and 92, as well as the gyroscopes 82 and 94. Since the slip rings 98 and brushes 100 are recess mounted, this further helps to reduce the overall height of the support assembly 14, which in turn helps to reduce the vertical swept arc of the main reflector 12. If used on an aircraft, then one preferred location for securing the stationary support plate 96 is on the crown of the aircraft, as illustrated in simplified form in FIG. 6 via reference numeral 106. However, it will be appreciated that the apparatus 10 can be used with any form of mobile platform such as a bus, train, truck, ship, rotorcraft, etc. Furthermore, the system 10 could be implemented onto a fixed structure if the need exists for a very compact, mechanically scanned aperture with a small swept volume. Rotary joint 66 is coupled via coaxial conductors 66*a* and 66*b* to electronics components within the mobile platform.

With further reference to FIG. 6, the azimuth DC motor 92 includes an output shaft 92*a* having a gear 92*b*. Gear 92*b* engages a toothed outer edge 96*a* of support plate 96 to enable the base portion 72 to be driven rotationally about an axial center of the azimuth rotary joint 66.

In one implementation the main reflector 12 and the subreflector 16 are preferably formed from graphite epoxy. However, any other composite materials offering lightweight and suitable structural strength could be employed. The support assembly 14 also preferably comprises a composite construction, and more preferably honeycomb/epoxy construction. The base portion 72 also preferably has a honeycomb construction. Forming the support assembly 14, as well as the main reflector 12 and subreflector 16 all from composite materials results in an especially lightweight antenna that is ideally suited for use on mobile platforms where the weight of an antenna is an important consideration. The use of lightweight materials for the main reflector 12, the subreflector 16 and the support assembly 14 also reduces the driving forces needed to mechanically scan the main reflector 12 and permits the use of inexpensive, lightweight stepper motors to achieve the needed azimuth and elevation rotation, thereby eliminating the need for expensive and heavy servo motor systems.

It will be appreciated that the precise shape of the main reflector 12, as well as the precise positioning and shape of the subreflector 16, are "shaped" in accordance with known mathematical models to provide the needed curvature for components 12 and 16. Placement of the subreflector 16 relative to the main reflector 12, which is of high importance to optimal electromagnetic performance of the antenna system, is also determined in accordance with known mathematical modeling.

Figure 7:
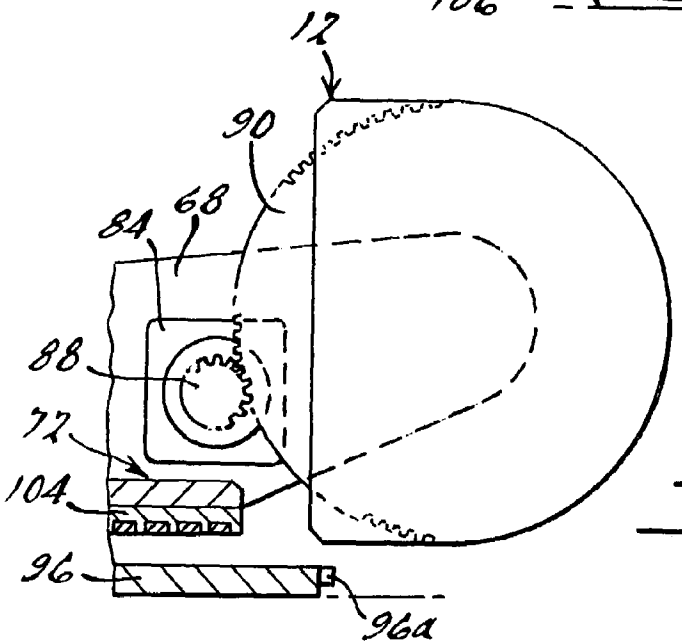
FIG. 7 is a partial, cross sectional side view taken in accordance with section line 7-7 in FIG. 5 illustrating the elevation drive mechanism.
Figure 8:
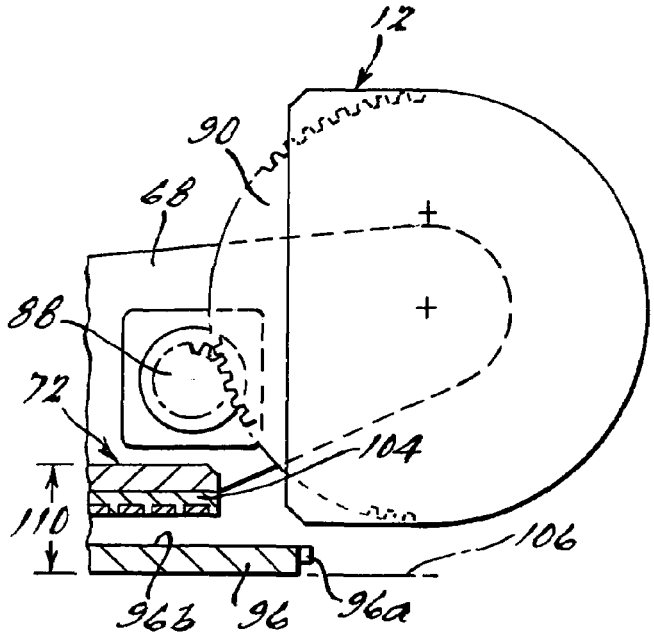
FIGS. 8-10 illustrate various positions of the main reflector, as well as the height reduction of the swept arc achieved with the system.
Figure 9:
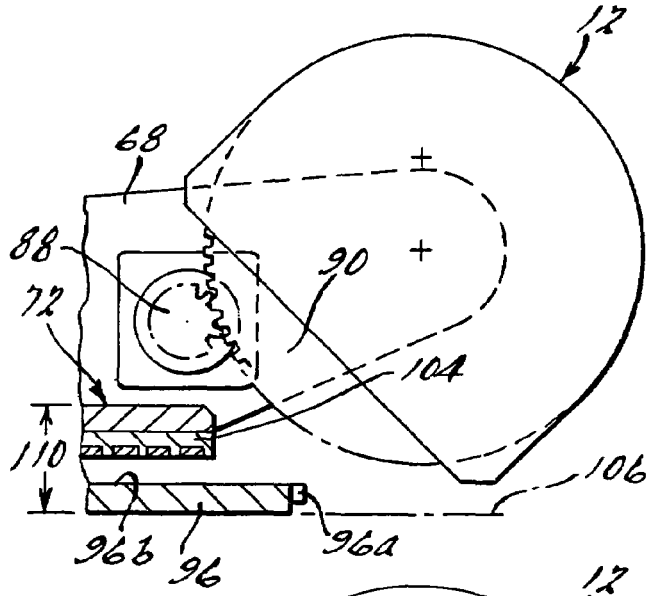
Figure 10:
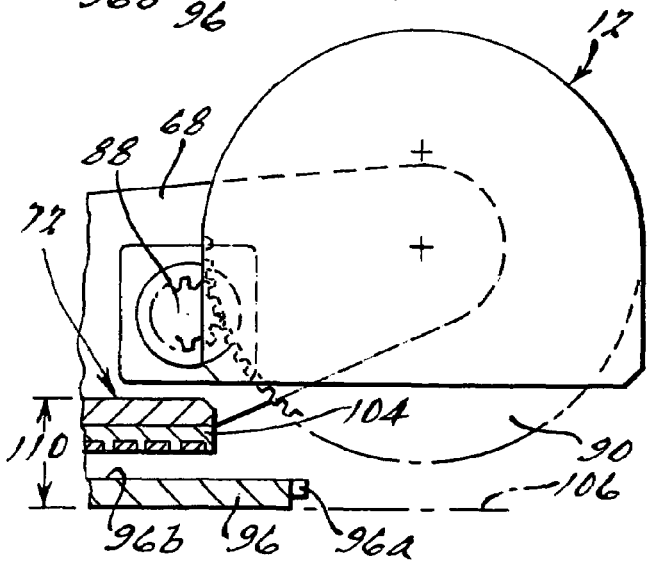
Figure 11:
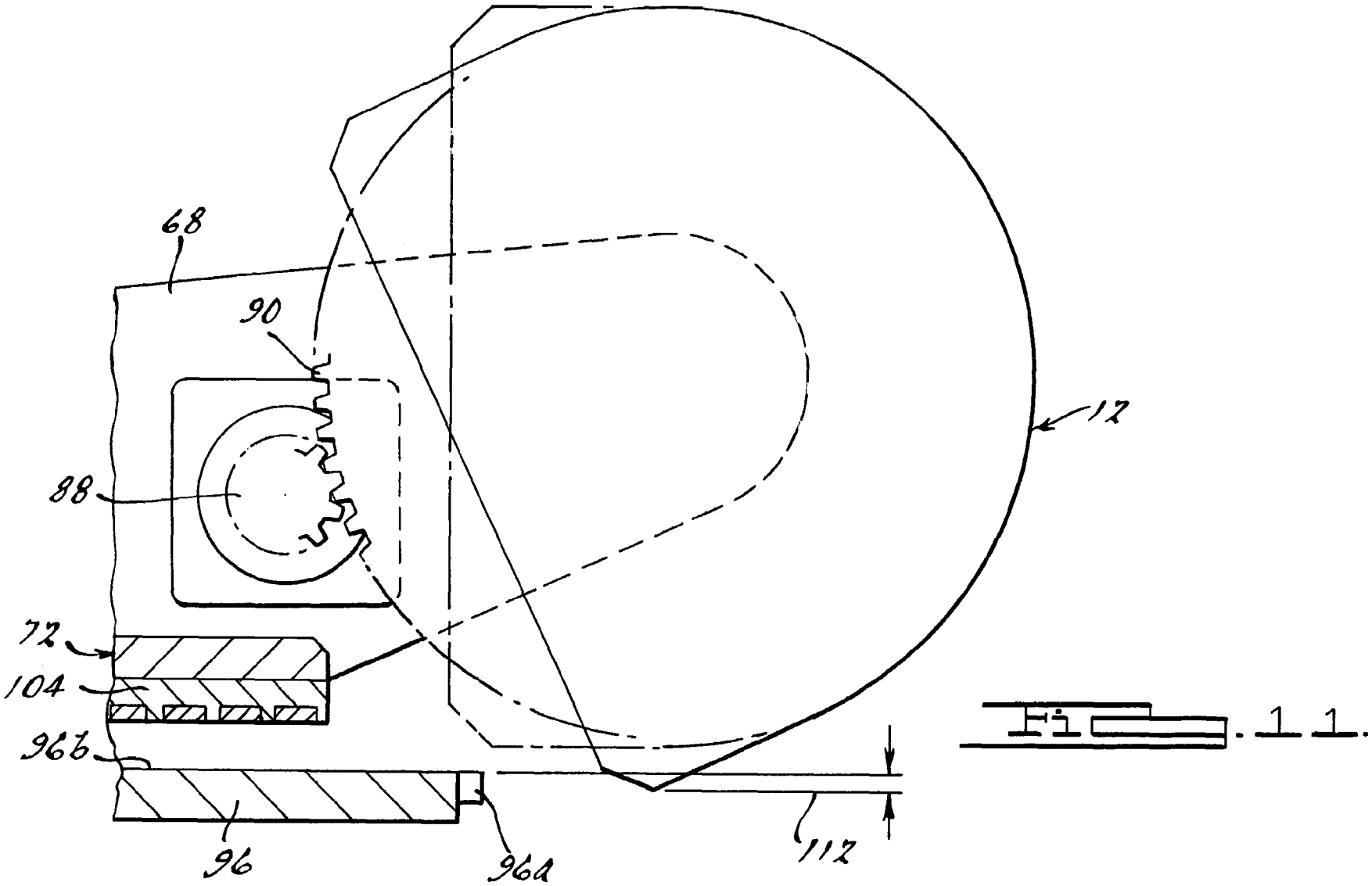
FIG. 11 further illustrates the manner in which the main reflector is able to rotate slightly below the upper surface of the stationary mounting platform.

Referring to FIGS. 6 and 7, and particularly to FIGS. 8-11, the benefit of cantilevering the main reflector 12 from the support arms 68 and 70 can be seen. This support arrangement allows the main reflector 12 to be supported forwardly of the forward edge 96*a* of the support plate 96. Thus, the main reflector 12 can be positioned such that a portion of it extends below an upper surface 96*b*, and thus rests closer to an outer surface 106 of a support structure on which the system 10 is mounted (in this example, the fuselage of a mobile platform). Dashed line 108 represents the position of the main reflector 12 when it is pointed parallel to the azimuth axis. The overall height of a radome used to enclose the system 10 can thus be reduced. Arrow 110 in FIGS. 8-10 represents the reduction in the overall height of the vertical swept arc achieved by cantilevering the main reflector 12 forwardly of the forward edge 96*a* of the support plate 96. FIG. 11 highlights that the main reflector 12 is able to extend below the upper surface 96*b* of the support plate 96. Dimension 112 represents the distance that the main reflector 12 is able to move below the upper surface 96*b* of the support plate 96.

When using a main reflector having an overall length of about 25.6 inches (64.51 cm) and an overall height of 8.9 inches (22.60 cm), a swept diameter of about 32 inches (81.28 cm) or less can be obtained. Accordingly, the system 10 provides a mechanically scanned reflector antenna assembly able to operate in the Ka or Ku frequency band, which can be covered with a smaller radome than previously developed, mechanically scanned reflector antenna assemblies.

In many applications, and especially with commercial and military jet aircraft, the reduction in weight is also a very important consideration. The reduction in weight can lead to improved fuel economy and thus a lower operating cost for the aircraft. The present invention enables a lightweight, mechanically scanned reflector antenna system to be implemented that weighs below about 50 lbs. (22.72 kg).

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. An antenna apparatus comprising:

a main reflector having a composite construction;

a subreflector supported forwardly of said main reflector and also having a composite construction;

a support platform having a base portion and at least one cantilever arm for supporting the main reflector forwardly of the base portion, the main reflector further being pivotally supported from the base portion for pivoting about an elevation axis, and further such that a portion of the main reflector can be disposed below an upper surface of the base portion and said main reflector rotated about said elevation axis without interference from said base portion;

a rotary electrical joint disposed on said base portion to enable rotation of said support platform and said main reflector about an azimuth axis while enabling electrical coupling of said main reflector with an external electronic component; and wherein said base portion including an azimuth drive motor for driving said base portion rotationally about said azimuth axis.

2. The antenna apparatus of claim 1, wherein said main reflector is comprised of graphite epoxy.

3. The antenna apparatus of claim 1, wherein said support platform is comprised of a composite construction.

4. The antenna apparatus of claim 1, wherein said main reflector includes a diplexer and an orthomode transducer (OMT) supported from a rear surface thereof.

5. The antenna apparatus of claim 1, wherein said support platform includes an elevation axis motor having an output shaft with a gear; and wherein said main reflector includes a gear rack on a rear surface thereof for engaging said gear and enabling said motor to drive said main reflector pivotally about said elevation axis.

6. The antenna apparatus of claim 1, further including an elevation axis gyroscope supported from a rear surface of said main reflector.

7. The antenna apparatus of claim 1, further comprising an azimuth axis gyroscope.

8. An antenna apparatus comprising:

a main reflector having a composite construction;

a subreflector supported from a front surface of said main reflector, said subreflector having a composite construction;

at least one of a diplexer, a low noise amplifier and an orthomode transducer supported from a rear surface of said main reflector;

a support platform assembly for supporting said main reflector for rotation about each of an azimuth axis and an elevation axis;

wherein said support platform assembly includes a base portion and a pair of arms extending forwardly of said base portion for supporting said main reflector forwardly of said base portion, and for pivoting movement about an elevation axis for enabling a portion of said main reflector to extend below an upper surface of said base portion; and wherein said support platform assembly comprises a composite construction.

9. The antenna apparatus of claim 8, further comprising an elevation axis drive motor for driving said main reflector pivotally about said elevation axis.

10. The antenna apparatus of claim 8, further comprising a rotary coaxial joint housed in said support platform assembly for electrically coupling said components mounted on said rear surface of said main reflector with at least one electronic subsystem located externally of said antenna apparatus.

11. The antenna apparatus of claim 8, wherein said base portion comprises a composite honeycomb construction.

12. The antenna apparatus of claim 8, further comprising an elevation coaxial rotary joint disposed one of said arms for electrically coupling at least one of said components supported from said rear surface of said main reflector with an external electronics subsystem.

13. The antenna apparatus of claim 8, further comprising at least one band pass filter supported from said rear surface of said main reflector.

14. The antenna apparatus of claim 8, further comprising at least one of an azimuth axis gyroscope and an elevation axis gyroscope supported on said support platform assembly.

15. An antenna apparatus comprising:

a main reflector having a composite construction;

a subreflector supported from a front surface of said main reflector, said subreflector having a composite construction;

at least one of a diplexer, a low noise amplifier and an orthomode transducer supported from a rear surface of said main reflector;

a toothed track supported from said rear surface of said main reflector;

a support platform assembly for supporting said main reflector for rotation about each of an azimuth axis and an elevation axis;

wherein said support platform assembly includes a base portion and a pair of arms extending forwardly of said base portion for supporting said main reflector forwardly of said base portion, and for pivoting movement about an elevation axis for enabling a portion of said main reflector to extend below an upper surface of said base portion;

a motor supported on said support platform and having a gear in engagement with said toothed track to drive said main reflector about said elevation axis; and said support platform assembly including a composite construction.

16. The apparatus of claim 15, further comprising a coaxial rotary joint operably associated with said support platform for enabling rotation of said support platform about said azimuth axis.

17. The apparatus of claim 15, further comprising an elevation axis gyroscope supported from said support platform.

18. The apparatus of claim 15, further comprising an azimuth axis gyroscope supported from said support platform.

19. The apparatus of claim 15, wherein said main reflector and at least portions of said support platform are comprised of graphite epoxy.

* * * * *